United States Patent [19]

Gyger et al.

[11] 4,389,751

[45] Jun. 28, 1983

[54] APPARATUS FOR SEVERING A FIBRE LAYER OF STAPLE FIBRES

[75] Inventors: Paul Gyger, Seuzach; Hugo Schär, Neftenbach, both of Switzerland

[73] Assignee: Rieter Machine Works Limited, Winterthur, Switzerland

[21] Appl. No.: 243,933

[22] PCT Filed: Jul. 5, 1980

[86] PCT No.: PCT/EP80/00044

§ 371 Date: Mar. 9, 1981

§ 102(e) Date: Mar. 2, 1981

[87] PCT Pub. No.: WO81/00118

PCT Pub. Date: Jan. 22, 1981

[51] Int. Cl.³ ..... D01G 1/08; D01H 5/86

[52] U.S. Cl. ..... 19/0.35; 19/258

[58] Field of Search ..... 19/0.3, 0.35, 0.37, 19/0.39, 0.41, 0.43, 236, 242, 258; 225/1-5, 93, 103

[56] References Cited

U.S. PATENT DOCUMENTS

| | | | |
|---|---|---|---|
| 2,679,070 | 5/1954 | Hood | 19/0.37 |
| 2,797,444 | 7/1957 | Takagi et al. | 19/0.35 X |
| 3,060,669 | 10/1962 | Kingsbury | 19/0.35 X |
| 4,192,041 | 3/1980 | Sasaki | 19/0.35 |

FOREIGN PATENT DOCUMENTS

| | | |
|---|---|---|
| 456591 | 8/1944 | Belgium . |
| 910754 | 3/1954 | Fed. Rep. of Germany . |
| 967366 | 8/1964 | United Kingdom . |
| 1015240 | 12/1965 | United Kingdom . |

*Primary Examiner*—Louis Rimrodt

*Attorney, Agent, or Firm*—Werner W. Kleeman

[57] ABSTRACT

The present invention concerns an apparatus for severing a fibre layer (3) composed of mutually slidable staple fibres, and containing two driven pairs of rolls (9/10; 11/12) forming two nip lines for the fibre layer (3) guided therebetween. Severing is achieved in that the two pairs of rolls (9/10; 11/12) are kinematically coupled using a flexible power transmitting element (19) in such a manner that by moving a roll tandem (26) contained in the path of movement of the power transmitting element (19) one pair of rolls (11/12) is rotated relative to the other one (9/10). Owing to this relative rotation of the pairs of rolls the fibre layer clamped between the nip lines is severed. This apparatus presents the advantage that its design is simple and reliable and that, in particular, no clutch is required.

7 Claims, 1 Drawing Figure

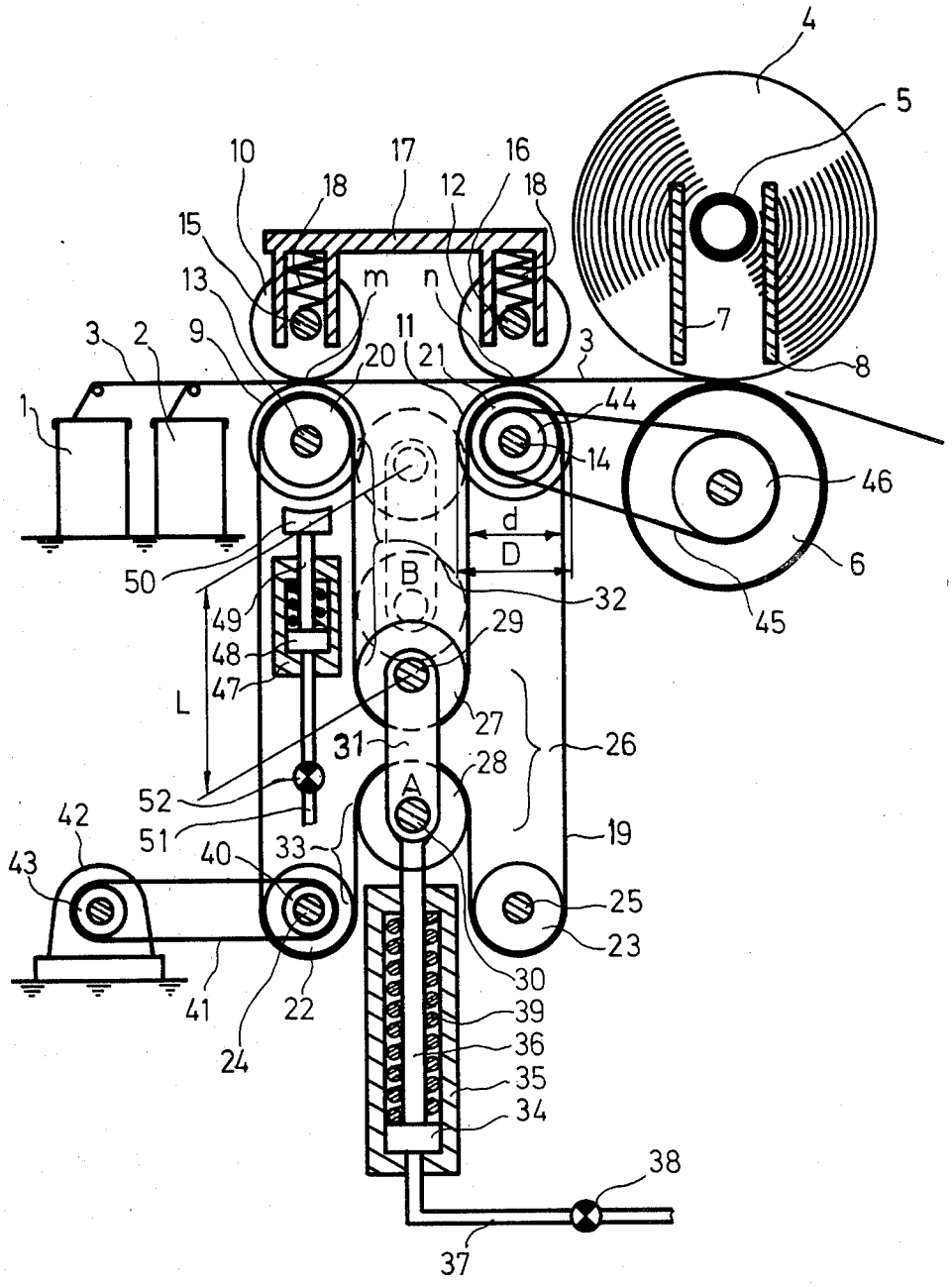
4
5
10
17
16
18
12
18
15
13
m
n
7
3
2
9
11
3
20
21
8
1
44
14
46
d
D
50
B
32
6
49
29
45
48
47
L
27
31
26
28
52
A
51
42
19
43
40
33
25
23
30
41
22
39
24
36
35
34
38
37

APPARATUS FOR SEVERING A FIBRE LAYER OF STAPLE FIBRES

BACKGROUND OF THE INVENTION

The present invention concerns an apparatus for severing a fibre layer composed of mutually slideable staple fibres, with two driven pairs of rolls, which form two nip lines for the fibre layer guided therebetween.

The term fibre layer as used in the context of the present invention and this disclosure is understood to describe any fibre array extending in longitudinal direction, independently of the form of its cross-section, i.e. fibre arrays of circular or centrally symmetrical cross-sections (such as e.g. the drawframe slivers in staple fibre spinning) as well as of elongated cross-sections (such as e.g. the fibre layer in a lap-forming machine or the web of a card in staple fibre spinning), in which the fibres are arranged in any shape (e.g. as longitudinally extended individualized fibres or flocks) and cohere substantially only owing to the interfibre adhesion forces.

Severing a fibre layer is known to be effected by guiding the fiber layer through the nip lines of two consecutive driven pairs of rolls, the surface speeds of which (which for continuous transport of the fibre layer without a draft are chosen the same, or, if a draft is to be effected between the nip lines, are chosen in a ratio corresponding to the draft ratio desired) can be changed relative to each other to such a degree, that the fibre layer is torn apart and thus is severed. Such severing methods are described, e.g. in German Pat. No. 910 754, in which it is shown already also, in which manner, according to first solutions the severing is effected by a sudden acceleration of the pair of delivery rolls, arranged, as seen in the direction of fibre transport, as the subsequent pair of rolls, as it can be effected, according to a further solution, by suddenly slowing down the pair of input rolls arranged as the first pair of rolls, as seen in the direction of fibre transport. These two solutions operate under application of at least one clutch, by means of which the drive of the pair of delivery rolls can be coupled with a faster rotating shaft for acceleration, or, respectively, the drive of the pair of input rolls can be de-clutched, and thus, the pair of input rolls can be brought to standstill.

These solutions show the disadvantage that a complicated drive system for the pairs of rolls, with at least one clutch, is required, which renders the device expensive and requires a great deal of maintenance work.

SUMMARY OF THE INVENTION

It thus is an important object of the present invention to propose an apparatus of the type mentioned initially, which is of simple and reliable design, requiring a minimum of maintenance work, and in particular does not require a clutch in the drive arrangement for both pairs of rolls.

This object is achieved by an apparatus of the type mentioned initially, which is characterized in that the two pairs of rolls are kinematically coupled using a flexible power transmitting element, and that the element is guided about the drive roll of the driven roll of each pair of rolls, and about at least two further deflecting rolls, which are fixed relative to the room, as well as about two rolls, which are movable with respect to the room and are interconnected into a roll tandem, in such a manner that it forms a a respective loop between the drive rolls and one of the rolls of the tandem, and between the two deflecting rolls and the other roll of the tandem, such that, as the movable roll tandem is moved, one of the loops is shortened by a certain length, while the other one is lengthened by the same length, and that thus one pair of rolls can be rotated relative to the other one, the fibre layer clamped between the nip lines being severed by drafting.

BRIEF DESCRIPTION OF THE DRAWINGS

The invention is described in more detail in the following with reference to an illustrated design example and further preferred embodiments.

In the single FIGURE a schematic, much simplified view of the inventive apparatus is shown, used according to a preferred embodiment of the invention in a lap-forming machine of a combing preparatory process.

DETAILED DESCRIPTION OF THE PREFERRED EMBODIMENTS

In a machine of this type a plurality of staple fibre slivers (two only being shown in the example according to the FIGURE) are taken from creel cans 1 and 2 (shown schematically and in a much reduced scale in the FIGURE) and are doubled by suitable means (not shown), i.e. are lined up side by side and are integrated into a large fibre layer 3. A fibre layer 3 of such type usually is of a width of approximately 300 mm. This fibre layer 3, which forms a thick layer, is wound onto a lap 4. This is effected in that the fibre layer 3 at the start of the winding process is fixed on the surface of the tube 5 in any suitable manner. The tube 5 is contactingly supported on a friction drive drum 6, which is driven by drive means described later on, and is rotated by the friction drive drum 6 which is in frictional contact drive with tube 5. In this process the fibre layer 3 is wound onto the tube 5 and forms a lap 4, the diameter of which increases accordingly. The tube 5 of course moves correspondingly with respect to the friction drive drum 6, which is effected by corresponding holding means. In the example shown, such holding means are of the form of two guides 7,8 arranged at right angles to the friction drive drum 6, which guide the tube 5 at both rims (one rim only being shown). Of course, also other types of holding means can be provided for holding the tube 5, such as closing arms guiding the tube 5 along a circular path, etc.

In this arrangement it is also possible for the tube 5 to be pressed against the friction drive drum 6 by suitable means (not shown), for enhancing the entrainment effect exerted by the friction drive drum 6. Furthermore, an arrangement is possible wherein the drive of the lap 4 is not effected by frictional contact of the friction drive drum 6, but instead in that the tube 5 itself is driven by drive arrangements (not shown), suitable control means taking care of continuous adaption of the lap rotational speed to the increasing diameter. Also mixed drive arrangements, i.e. combinations of a direct drive of the lap 4 and by a friction drive drum, also are applicable within the scope of the present invention.

Immediately upstream of, as seen in the direction of movement of the fibre layer 3, the lap 4, it is contemplated according to the invention to provide two pairs of rolls 9/10 and 11/12, which form two nip lines m and n for the fibre layer 3 guided therebetween. The lower rolls 9 and 11 of the pairs of rolls in this arrangement are driven rolls, as to be explained in more detail later on, and are supported to be rotatable about the axes or shafts 13 and 14 in bearings (not shown) fixed with respect to the room on a machine frame (also not shown).

The upper rolls 10 and 12 of the pairs of rolls, on the other hand, are designed as pressure rolls, which are guided to be movable vertically in a body 17 which is fixed relative to the room or space and provided with vertical guides for the corresponding axes or shafts 15 and 16, and which are pressed against the driven rolls 9 and 11, respectively, by using a related pressure spring 18.

The two driven rolls 9 and 11 of the pairs of rolls 9/10 and 11/12 according to the invention are kinematically coupled by using a flexible power transmission element 19, the element 19 preferably being an element functioning slippage-free. According to a preferred embodiment of the invention the power transmission element 19 is a chain or a toothed belt, which meshes with corresponding pulleys for slippage-free transmission of power and movement.

The power transmission element 19 in this arrangement is guided about the drive roll 20 and 21, respectively, of the driven roll 9 and 11, respectively, of each pair of rolls, and about at least two further deflecting or space rolls 22 and 23 arranged fixed with respect to the room and the axes 24 and 25 of which are rotatably supported in the machine frame (not shown). Furthermore, in the path of movement of the power transmitting element 19 there are provided two rolls 27 and 28, which are movable with respect to the room or space and which are interconnected into a roll tandem 26. The axes or shafts 29 and 30 of the rolls 27 and 28 for this purpose are rotatably supported in a common bearing body 31. Owing to this arrangement of the rolls 20, 21, 22, 23, 27 and 28 the power transmitting element 19 forms a respective loop 32 and 33 between the drive rolls 20 and 21 and the roll 27, and between the two deflecting rolls 22, 23 and the roll 28. Since the rolls 20, 21, 22 and 23 are fixed with respect to the room or space, the circumference of the flexible power transmitting element 19 is independent of the position of the roll tandem 26. As the roll tandem 26 moves, e.g. from its position A, indicated with solid lines in the FIGURE, into the position B, indicated with broken lines, the loop 32 is shortened by the length L and the loop 33 is lengthened by the same length L, which, however, requires a relative rotation of one of the pairs of rolls 9,10 and 11,12 with respect to the other.

For moving the roll tandem 26, according to the FIGURE, a system comprising a piston 34 and a cylinder 35 is provided, the piston rod 36 of which is directly connected to the bearing or mounting body 31. The cylinder 35 is connected via a duct 37 with a valve 38 and with a pressure source (not shown) for a suitable fluid medium, and such cylinder 35 contains a resetting spring 39. As the valve 38 is opened, the pressure medium flows into the cylinder 35 from below and moves the piston 34 including the piston rod 36 upward, the force exerted by the resetting spring 39 being overcome in such a manner that the bearing body 31 is moved from, e.g. the position A into the position B. As the pressre in the cylinder 35 is released, the piston 34 including the bearing body 31 is brought back to its initial position under the influence of the force of the resetting spring 39. Of course also other methods (e.g. purely mechanical drives using gear rack and pinion arrangements, not shown) are applicable.

For driving the rolls and the power transmitting element 19, according to the design example shown in the FIGURE, the shaft 24 of the deflecting roll 22 is equipped with a belt pulley 40 for a belt 41. The belt 41 is driven by a motor 42 equipped with a belt pulley 43, and thus, drives the power transmitting element 19 so as to perform a revolving motion. Furthermore, the arrangement is constituted such that the friction drive drum 6 is driven from the shaft 14 of the roll 11 via a belt pulley 44, a belt 45 and a belt pulley 46, in such a manner, that between the roll 11 and the friction drive drum 6 there prevails a kinematic coupling. The belt 45 in this arrangement is preferably chosen as a toothed belt. Instead of a belt drive arrangement also a chain drive arrangement can be considered for driving the friction drive drum 6. The ratio of the diameters of the belt pulleys 44 and 46 is chosen substantially equal to the ratio of the diameters of the roll 11 and the friction drive drum 6, in such a manner that between the nip line n and the friction drive drum 6 the fibre layer 3 is not subject to any draft (not considering a possible tensioning draft, neglegible in this context).

The here illustrated type of drive of the power transmitting element 19 and of the friction drive drum 6 is not the only one which can be considered within the scope of the present invention: thus the drive of the element 19 could be effected, e.g. by driving the shaft 13 of the roll 9, whereas the friction drive drum 6 could be driven by kinematically coupling with the shaft 25 of the deflecting roll 23.

Furthermore, it is to be noted that the rolls 9 and 11 (as shown in the FIGURE) need not necessarily possess the same diameter and/or need not be kinematically coupled by using drive rolls 20 and 21 of the same dimensions. If this is the case, both driven rolls 9 and 11 of the pairs of rolls 9/10 and 11/12 rotate at the same surface speed, in such manner that the fibre layer 3 is carried on between the nip lines m and n without drafts, as the power transmitting element 19 circulates around the roll tandem 26 which is not moved with respect to the room or space. If, however, the fibre layer 3 is to be subject to a determined draft at all times during operation of the apparatus, then it is only necessary to correspondingly choose the above mentioned diameters of the rolls 9 and 11 and/or of the drive rolls 20 and 21: the pairs of rolls 9/10 and 11/12 in this case respectively act in known manner as the take-in pair of rolls 9/10 and the delivery pair of rolls 11/12 of the drafting zone of a drafting arrangement.

In a preferred alternative design example it further is contemplated that during the movement of the roll tandem 26 one of the pairs of rolls is stopped with respect to the other, such that the relative rotation of the second pair of rolls is effected with respect to a pair of rolls which is at a standstill. This is achieved, e.g. in the apparatus shown in the FIGURE, in that the roll 9 is directly braked by a brake 50 activated via a system comprising a cylinder 47, a piston 48 and a piston rod 49. The piston 48 is activated via valve 52 and duct 51. This depicted manner of holding the pair of rolls 9/10 at standstill represents just one of many possible arrangements which could be utilized: Thus, e.g. application of a so-called stop-motor, i.e. of a motor equipped with a brake, instead of motor 42, also could be considered as a good solution.

The apparatus illustrated functions as follows:

During normal operation, i.e. while the lap 4 is being built up, the cylinders 35 and 47 are not under pressure, i.e. the roll tandem 26 is in its lower position A, and the roll 9 is not braked.

The drive motor 42 in this arrangement drives via the belt 41 and the power transmission element 19, the pairs of rolls 9/10 and 11/12, which continuously transport the fibre layer 3 from the cans 1 and 2 to the lap 4. The lap 4 rotates since it is frictionally driven by the friction drive drum 6, which also is driven by the motor 42, and the fibre layer 3 is wound onto the lap surface.

When the lap or package 4 has reached its predetermined final diameter, the motor 42 is stopped. In this arrangement the fibre layer 3 is continuously maintained between the nip lines m and n and from the nip line n to the lap 4.

Now the lap or package 4 is to be exchanged against a new, empty tube 5, and that the fibre layer 3 is to be severed in this process.

For this purpose the valves 52 and 38 are activated simultaneously or one shortly after the other, such that the brake 50 is activated and that the roll tandem 26 is moved from its lower position A into its upper position B, indicated with broken lines. As the roll tandem 26 is moved over the distance L while the roll 9 is braked, the drive roll 21 and the deflecting roll 23 effect a clockwise rotation, which causes rotation of the rolls 11, 12 in the sense of transporting the fibre layer 3 from the left hand side to the right hand side. Since the rolls 9,10 are at a standstill, the fibre layer 3 is severed between the nip lines m and n by drafting it apart, which is the object of the invention.

Between the path of movement or displacement path L of the roll tandem 26, the diameter d of the drive roll 21 of the driven roll 11 of the pair of rolls 11/12 which is further rotated, the diameter D of the driven roll 11 and the maximum staple lengths of the fibre layer 3 there preferably prevails the following relation:

$$L > (s \cdot d)/2D$$

Maintenance of this relation ensures that the movement of the fibre layer 3 to the right hand side of the showing of the drawing by the pair of rolls 11/12 exceeds the maximum staple length s, i.e. that the fibre layer is severed completely.

It is to be noted that with the rotation of the roll 11 the friction drive drum 6, which is kinematically coupled with the roll 11, is also always rotated further over the same surface length, in such a manner that the fibre layer 3 always is correctly wound onto the lap surface of the lap or package 4.

After the fibre layer 3 is severed between the nip lines m and n, the severed end of the fibre layer (not shown) can be wound onto the lap surface of the lap 4 according to two methods, the lap 4 thus being prepared for the exchange thereof.

According to a first method the drive motor 42 can be started up again for a short period of time; in this process, as during normal operation, the rolls 9, 11 and 6 are driven such, that the fibre layer upstream and downstream of the severing point is moved from the left to the right. When the end of the layer on the lap side has reached the surface of the lap 4, the motor 42 is stopped again, and the lap or package 4 is exchanged against a new, empty tube 5 either by hand, or automatically, using known means (not shown).

According to a second method, the translatory displacement path L of the roll tandem 26 can be chosen such, that by the relative rotation of the rolls 11, 12 and 6 with respect to the rolls 9, 10 not only the fibre layer 3 is severed, but that the severing point of the fibre layer 3, or its end on the lap side, respectively, is transported to the surface of the lap 4, while the rolls 9 and 10 are at standstill. Also in this arrangement, the lap change operation can be effected in known manner.

Resetting the roll tandem 26 from the position B to its position A for normal operation (effected by the resetting spring 39 while the cylinder 35 is not pressurized) in this second case (in which between the nip line n and the rolls 11, 12 no fibre layer 3 remains) can be effected immediately during the exchange operation; it is of no consequence in this arrangement, whether the rolls 11 and 12 are to be rotated back (counter-clockwise) for this purpose. If, however, the first mentioned method is applied, in which the fibre layer 3 passes the nip line n of the pair of rolls 11/12 already before the change operation takes place, resetting of the roll tandem 26 from the position B into its position A is to be effected during normal operation, i.e. during the subsequent phase of build-up of the next lap 4. In this arrangement this movement is effected at such a low speed with respect to the surface speed of the rolls 9, 11 and 6, that the naturally resulting change in fibre mass of the fibre layer 3 after passage through the rolls 11, 12 is negligible.

While there are shown and described present preferred embodiments of the invention, it is to be distinctly understood that the invention is not limited thereto, but may be otherwise variously embodied and practiced within the scope of the following claims. Accordingly,

What we claim:

1. An apparatus for severing a fibre layer composed of mutually slidable staple fibres, comprising:

two pairs of driven rolls;

said two pairs of driven rolls forming two nip lines for the fibre layer which is guided therebetween;

a flexible power transmitting element for kinematically coupling said two pairs of rolls;

each of said pairs of rolls containing a driven roll;

a respective drive roll provided for each driven roll of said two pairs of rolls;

at least two further deflecting rolls which are fixed relative to space and two rolls which are movable with respect to space;

means for interconnecting said two rolls to define a roll tandem;

said power transmitting element being guided about the drive roll of the driven roll of each pair of rolls and about said at least two further deflecting rolls which are fixed relative to space and about said two rolls which are movable with respect to space in such a manner that said power transmitting element forms a respective loop between the drive rolls and one of said rolls of said roll tandem and between the two deflecting rolls and the other roll of said roll tandem; and one of said loops being shortened by a certain length whereas the other loop is lengthened by essentially the same length as the movable roll tandem is moved, so that one of said pairs of rolls can be rotatated relative to the other pair of rolls and the fibre layer clamped between the nip lines can thus be severed by being pulled apart.

2. Apparatus according to claim 1, wherein: the power transmitting element comprises a slippage-free operating element.

3. Apparatus according to claim 2, wherein: said element operating slippage-free comprises a chain.

4. The apparatus according to claim 2, wherein: said element operating slippage-free comprises a toothed belt.

5. The apparatus according to claim 1, wherein: said severing apparatus is employed in a lap forming machine of a combing preparatory process and is used for severing the fibre layer as the lap is changed.

6. Apparatus according to claim 1, wherein (26) during the movement of the roll tandem (26) one of the pair of rolls is kept at standstill.

7. Apparatus according to claim 6, wherein: the following relation is maintained:

$$L > (s \cdot d)/2D$$

where:

L = path of movement of the roll tandem s = maximum staple length of the fibres forming the fibre layer, D = diameter of the driven roll of the pair of rolls driven further by the movement of the roll tandem, and d = diameter of the drive roll of the driven roll.

* * * * *

UNITED STATES PATENT AND TRADEMARK OFFICE

CERTIFICATE OF CORRECTION

PATENT NO. : 4,389,751

DATED : June 28, 1983

INVENTOR(S) : PAUL GYGER et al

It is certified that error appears in the above-identified patent and that said Letters Patent are hereby corrected as shown below:

Column 6, line 63, read "rotatated" as --rotated--

Column 7, line 12, delete "(26)",

Column 7, line 13, delete "(26)".

Signed and Sealed this

*Thirteenth* Day of *September 1983*

[SEAL]

*Attest:*

GERALD J. MOSSINGHOFF

*Attesting Officer*

*Commissioner of Patents and Trademarks*